US011047070B2

(12) United States Patent
Schwemmlein et al.

(10) Patent No.: US 11,047,070 B2
(45) Date of Patent: Jun. 29, 2021

(54) CLAMPING APPARATUS FOR A RELEASABLE CONNECTION OF A HARNESS CORD TO A LIFTING HEDDLE OF A LENO WEAVE APPARATUS

(71) Applicant: Gebrüder Klöcker GmbH, Borken-Weseke (DE)

(72) Inventors: Christoph Schwemmlein, Borken-Weseke (DE); Matthias Klöcker, Borken-Weseke (DE)

(73) Assignee: GEBRÜDER KLÖCKER GMBH, Borken-Weseke (DE)

( * ) Notice: Subject to any disclaimer, the term of this patent is extended or adjusted under 35 U.S.C. 154(b) by 89 days.

(21) Appl. No.: 16/437,479

(22) Filed: Jun. 11, 2019

(65) Prior Publication Data

US 2019/0376211 A1 Dec. 12, 2019

(30) Foreign Application Priority Data

Jun. 12, 2018 (DE) ..... 202018103292.5

(51) Int. Cl.
*D03C 7/00* (2006.01)
*D03C 3/42* (2006.01)
*D03C 9/02* (2006.01)

(52) U.S. Cl.
CPC *D03C 3/42* (2013.01); *D03C 7/00* (2013.01)

(58) Field of Classification Search
CPC ... D03C 7/00; D03C 7/06; D03C 7/02; D03C 7/005; D03C 9/02; D03C 3/24; D03C 3/40; D03C 3/42; D03C 7/08; D03D 51/46
See application file for complete search history.

(56) References Cited

U.S. PATENT DOCUMENTS 1,493,514 A * 5/1924 Aull ..... D03C 7/00 139/53
1,551,732 A * 9/1925 Colman ..... D03D 51/46 139/91
2,647,541 A * 8/1953 Nichols ..... D03C 7/00 139/50
3,952,778 A * 4/1976 Volpe ..... D03C 7/06 139/54
3,990,481 A * 11/1976 Graf ..... D03C 7/02 139/52
4,445,544 A * 5/1984 Krumm ..... D03C 7/06 139/54

(Continued)

FOREIGN PATENT DOCUMENTS

EP 0915195 B1 9/2002
EP 2236655 B1 11/2017

*Primary Examiner* — Robert H Muromoto, Jr.
(74) *Attorney, Agent, or Firm* — Dinsmore & Shohl LLP

(57) ABSTRACT

A clamping apparatus provides a releasable connection of a harness cord to a lifting heddle of a leno weave apparatus, wherein the releasable connection is configured as a clamping connection. The clamping apparatus has a clamping wedge and a wedge receiver device arranged at the end of the lifting heddle. The wedge receiver device displaceably receives the clamping wedge in the longitudinal direction of the lifting heddle. The harness cord is clampingly grippable between the wedge receiver device and the clamping wedge structure is provided for fixing the clamping wedge in the clamping receiver device.

15 Claims, 3 Drawing Sheets

(56) References Cited

U.S. PATENT DOCUMENTS

| | | | | | |
|---|---|---|---|---|---|
| 4,715,408 | A * | 12/1987 | Eisenlohr | D03C 7/06 | 139/54 |
| 4,721,135 | A * | 1/1988 | Tsubata | D03D 27/06 | 139/46 |
| 5,419,375 | A * | 5/1995 | Corain | D03C 7/00 | 139/54 |
| 5,582,213 | A * | 12/1996 | Okawa | D03C 7/005 | 139/46 |
| 6,311,737 | B2 * | 11/2001 | Wahhoud | D03C 7/00 | 139/50 |
| 7,185,679 | B2 * | 3/2007 | Schwemmlein | D03C 7/02 | 139/54 |
| 8,590,578 | B2 * | 11/2013 | Schwemmlein | D03C 7/06 | 139/35 |
| 9,850,597 | B2 * | 12/2017 | Hockemeyer | D03C 7/00 | |
| 2001/0013377 | A1 * | 8/2001 | Wahhoud | D03D 49/10 | 139/54 |
| 2003/0024589 | A1 * | 2/2003 | Baumann | D03C 7/00 | 139/11 |
| 2003/0188794 | A1 * | 10/2003 | Berktold | D03C 7/06 | 139/11 |
| 2013/0160890 | A1 * | 6/2013 | Schwemmlein | D03C 7/06 | 139/50 |
| 2017/0121866 | A1 * | 5/2017 | Hockemeyer | H02K 5/04 | |
| 2019/0376211 | A1 * | 12/2019 | Schwemmlein | D03C 3/42 | |
| 2020/0048797 | A1 * | 2/2020 | Schwemmlein | D03C 7/04 | |
| 2020/0199792 | A1 * | 6/2020 | Schwemmlein | D03C 9/02 | |

* cited by examiner

CLAMPING APPARATUS FOR A RELEASABLE CONNECTION OF A HARNESS CORD TO A LIFTING HEDDLE OF A LENO WEAVE APPARATUS

CROSS-REFERENCE TO RELATED APPLICATION

This application claims priority of German Utility model DE 20 2018 103 292.5 filed Jun. 12, 2018.

FIELD OF INVENTION

The invention relates to a clamping apparatus for a releasable connection of a harness cord to a lifting heddle of a leno weave apparatus, wherein the releasable connection is configured as a clamping connection.

BACKGROUND OF THE INVENTION

A leno weave apparatus is also sufficiently known from the prior art for Jacquard machines. Such a leno weave apparatus for a Jacquard machine is described, for example, in EP 2 236 655 that comprises two lifting heddles and a half-heddle alternately taken along by said lifting heddles. A fastening of the harness cord at the lifting heddles can also be recognized from this citation, namely of the kind that the lifting heddles have an eyelet at their upper ends, with the harness cords being connected to the eyelet by a conventional square knot.

A clamping apparatus of the initially named kind is known from EP 0 915 195 B1 in which the harness cord is guided in the form of a loop through an upper clamping opening of an elastic coupling member, with the coupling member being part of the lifting heddle. The two ends having the loop of the harness cord are threaded through a metal sleeve that is pushed over the coupling member to maintain a clamping connection. The regulation of the length of the harness cord takes place by releasing the clamping effect on the coupling member effected by the metal sleeve.

The assembly of the harness cord in the prior art as presented above is slightly complex in design due to the guidance of the loop-like end of the harness cord, which increases the assembly time.

SUMMARY OF THE INVENTION

The underlying object of the invention accordingly comprises providing a remedy in this respect.

It is proposed in accordance with the invention to achieve this object that the clamping apparatus has a clamping wedge and a wedge receiver device arranged at the end of the lifting heddle, wherein the wedge receiver device displaceably receives the clamping wedge in the longitudinal direction of the lifting heddle, wherein the harness cord is clampingly gripped between the wedge receiver device and the clamping wedge, and wherein means for fixing the clamping wedge in the wedge receiver device are provided.

It becomes clear from this that, between the clamping wedge on the one hand, and the wedge receiver device, on the other hand, in dependence on the position of the clamping wedge in the wedge receiver device, a spacing is formed between the clamping wedge, on the one hand, and the wedge receiver device, on the other hand, in which the harness cord runs. The harness cord can now be clampingly gripped between the clamping wedge, on the one hand, and the wedge receiver device, on the other hand, by displacing the clamping wedge relative to the wedge receiver device. To ensure that the clamping connection is maintained, means are provided that fix the clamping wedge in the wedge receiver device in the clamping position.

Advantageous features and embodiments of the invention result from further aspects discussed herein.

Provision is thus in particular made that the clamping wedge has a first contact surface for the harness cord that is advantageously toothed. The first contact surface for the harness cord advantageously extends at an angle a, for example between 10° and 20°, to the perpendicular, that is, to the longitudinal axis of the leno weave apparatus. Corresponding to this, the wedge receiver device has a second contact surface extending approximately in parallel with the first contact surface so that the harness cord is clampingly gripped on the displacement of the clamping wedge while tapering the spacing between the first and second contact surfaces.

It has already been presented at another point that means are provided for fixing the clamping wedge in the wedge receiver device. The means advantageously comprise a spring that acts on the clamping wedge. This means that the clamping wedge is under the load of a spring. The force of the spring thus acts on the clamping wedge in the longitudinal direction of the lifting heddle such that the clamping connection for the harness cord is maintained. However, this also means that the force of the spring is decisive for the clamping force. In this respect, in accordance with a further feature of the invention, the spring can be configured as a compression spring and particularly advantageously as a spiral spring. In fact, however, self-locking also occurs with respect to the harness cord; this is the case when the harness cord lies at the first and second contact surfaces and the harness cord is tensioned in the upward direction.

It is, however, also conceivable for the fixing of the clamping wedge in the part receiver device to provide the clamping wedge with a series of bores arranged above one another to guide a pin through the last visible bore after clamping the clamping wedge in the clamp receiver device for fixing the harness cord to thus effect a mechanical fixing of the position of the clamping wedge relative to the clamp receiver device.

Provision is advantageously made to ensure a defined movement of the clamping wedge in the wedge receiver device that the clamping wedge is guided in the wedge receiver device by a guidance device in the longitudinal direction of the leno weave apparatus. The guidance device here comprises at least one rail-like nose that is guided in a correspondingly formed groove. The rail-like nose can here be arranged at the clamping wedge, with a groove formed correspondingly thereto being let into the wedge receiver device. The converse case is also possible.

The wedge receiver device comprises a leg that serves for the connection to the lifting heddle. The leg has a guide for the spring, with the guide advantageously being configured as a guide bore. The guide bore advantageously has a longitudinally extending window through which the spring is accessible to be able to compress the spring on the insertion of the clamping wedge. The leg can be a separate element that is connected to the lifting heddle e.g. by adhesive bonding; it can, however, also be produced in one part together with the lifting heddle.

A subject matter of the invention is also a Jacquard machine having an apparatus in accordance with one or more of claims 1 to 12.

The invention will be described in more detail by way of example with reference to the drawings.

DETAILED DESCRIPTION OF THE PREFERRED EMBODIMENTS

Figure 1:
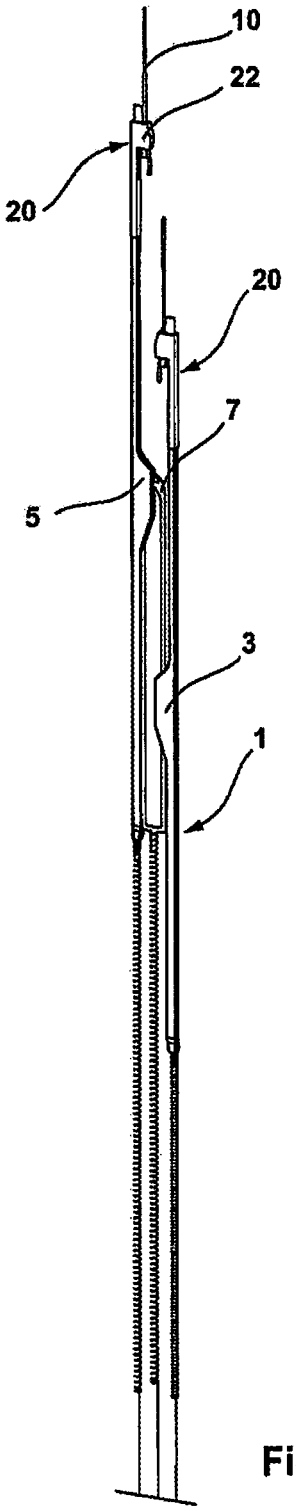
FIG. 1 shows the leno weave apparatus in a perspective representation with a clamping apparatus arranged at the upper end of the lifting heddles.

The leno weave apparatus 1 comprises the two lifting heddles 3 and 5 that each alternately entrain the lifting heddle 7 to form a leno weave. The principle is known, with reference being made in this respect, for example, to EP 2 236 655 B1. A subject matter of the invention is now the connection of the harness cord 10 to the respective lifting heddle 3, 5. The clamping apparatus 20 is provided for this purpose, with the clamping apparatus 20 comprising the wedge receiver device 22 and the clamping wedge 24 received by the wedge receiver device 22.

Figure 2:
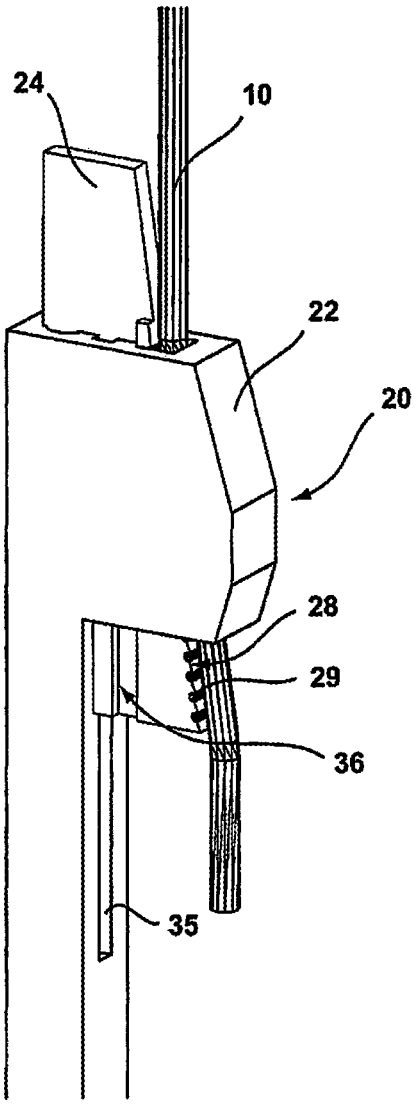
FIG. 2 shows the clamping apparatus in accordance with FIG. 1 in an enlarged representation, likewise in a perspective view.
Figure 3:
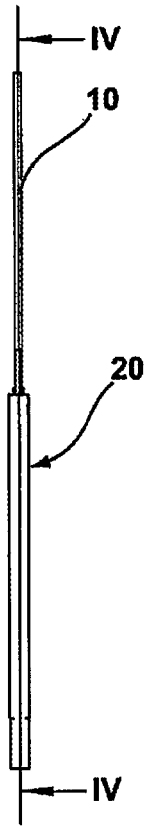
FIG. 3 shows a view of the narrow side of the clamping apparatus.
Figure 4:
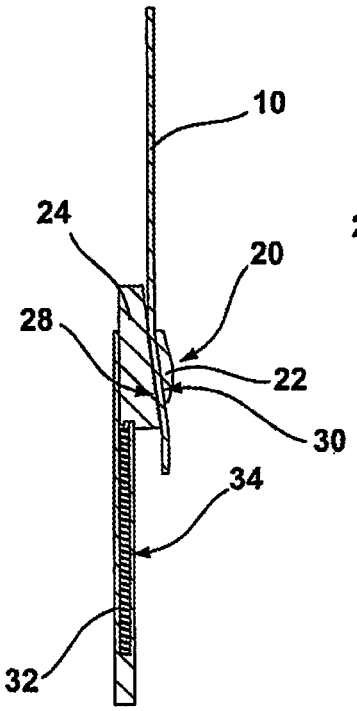
FIG. 4 shows a view in accordance with the section IV-IV of FIG. 3.
Figure 5:
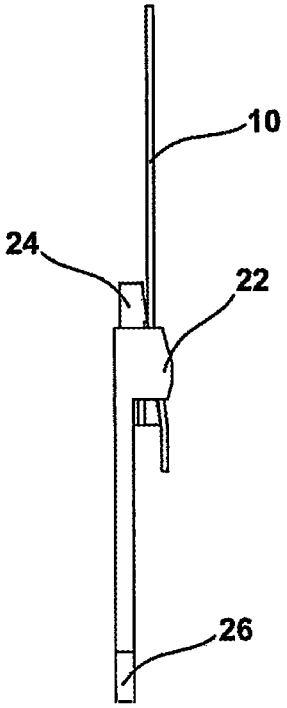
FIG. 5 shows a side view of the clamping apparatus.

FIG. 2 shows the clamping apparatus in an enlarged representation; it can already be recognized here that the clamping wedge has a first contact surface 28 that shows a toothed arrangement 29. It can also be recognized that the harness cord 10 contacts the first contact surface 28. The configuration of the clamping apparatus 20 now results in detail from FIG. 3 to FIG. 7. It can thus in particular be recognized from FIG. 4 that, corresponding to the first contact surface 28 of the clamping wedge 24 that advantageously extends at an angle of approximately 10° to 20° to the perpendicular, the wedge receiver device 22 has a corresponding second contact surface 30, with there being a spacing between the first contact surface 28 and the second surface 30 in which the harness cord 10 runs. The leg 26 is likewise recognizable as a part of the clamping apparatus 20. The leg 26 has a guide bore 34 for receiving the compression spring 32. The compression spring 32 in the leg 26 in the figurative representation acts on the clamping wedge from below so that the clamping wedge 24 endeavors under the load of the spring 32 to minimize the spacing between the first and second contact surfaces 28, 30 to thus establish the clamping connection for the harness cord 10. The guide bore 34 has an elongate window 35 through which the spring 32 is accessible to a pointed article. This is the case to be able to compress the spring 32.

Figure 6:
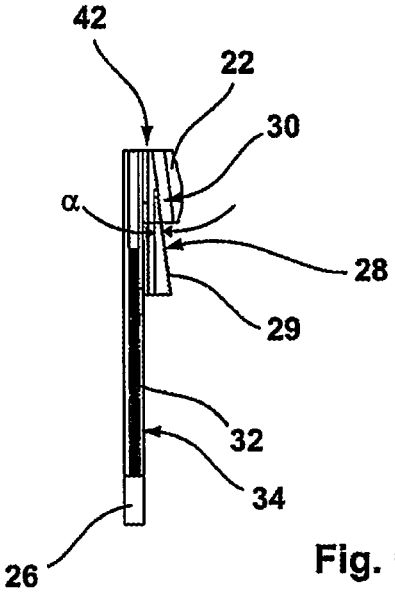
FIG. 6 shows the clamping apparatus in a position in which the harness cord is threadable into the clamping apparatus.
Figure 7:
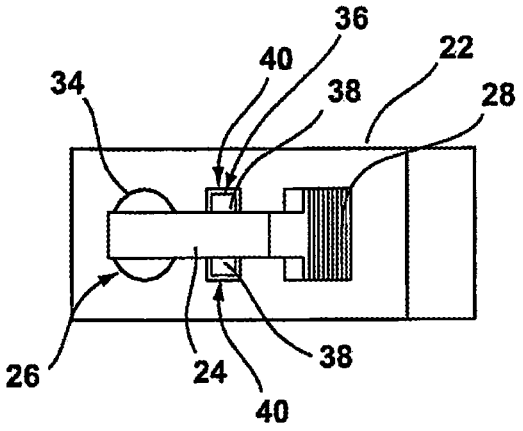
FIG. 7 shows a view from above of the clamping apparatus in the position of the clamping wedge in accordance with FIG. 6.

FIG. 6 in detail shows the position of the clamping wedge 24 in the wedge receiver device 22 for threading the harness core in accordance with the arrow 42. This means that in this case the spring 32 is compressed in the guide bore 34 of the leg 26. FIG. 7 shows a view from above of the clamping apparatus 20 in accordance with FIG. 6; it can be recognized here that the clamping wedge 24 is guided in the wedge receiver device 22 by a guidance device 36. The guidance device 36 in detail comprises a rail-like nose 38 that is arranged at both sides of the clamping wedge and that runs in a corresponding groove 40 in the wedge receiver device 22. The guide bore 34 for the spring 32 is likewise recognizable in the leg 26. The toothed first contact surface 28 of the clamping wedge 24 is likewise recognizable.

Figure 8:
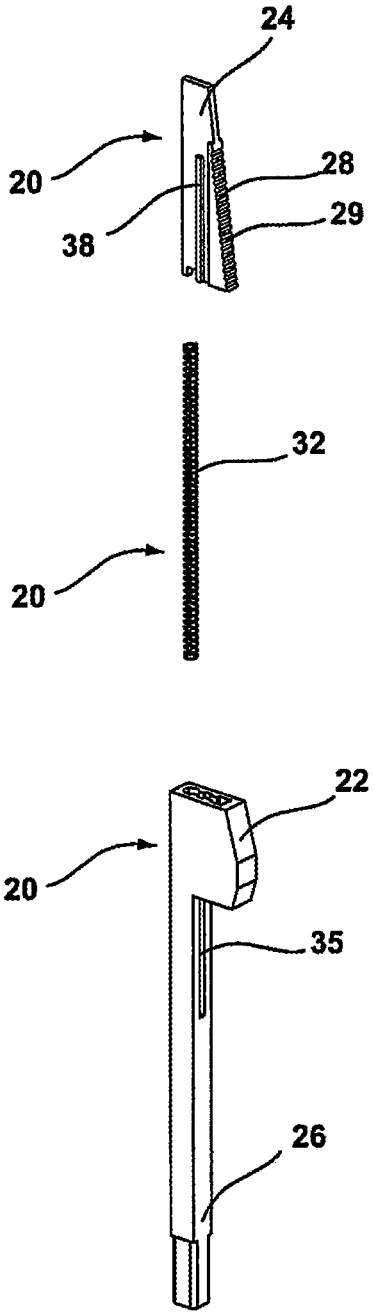
FIG. 8 shows an exploded representation of the clamping apparatus including the spring acting on the clamping wedge.

FIG. 8 shows the clamping apparatus 20 in an exploded representation; the leg of the clamping apparatus 20 can again in particular be recognized here that is connected at the lower end to the respective lifting heddle 3, 5, for example by adhesive bonding.

The assembly of the clamping apparatus 20 is now such that the clamping wedge 24 is pushed into the wedge receiver device 22 from below, with the spring previously having been introduced into the guide bore 34. The guide bore 34 has the window 35, with the spring being able to be compressed through the window 35, for example by means of a screwdriver, during the introduction of the clamping wedge. To thread the harness cord 10, the clamping wedge 24 is now pushed so far downward in the wedge receiver device 22 until, for instance, the upper side of the clamping wedge 24 terminates with, for example, the upper side of the wedge receiver device 22. The harness cord is then threaded in from above in accordance with the arrow 42 of FIG. 6. If the clamping wedge is relieved of the force applied from above, it springs upward due to the force of the spring 32 and to this extent effects the clamping connection for the harness cord 10.

As will be clear to those of skill in the art, the herein described embodiments of the present invention may be altered in various ways without departing from the scope of the invention. The invention is defined by the claims.

REFERENCE NUMERAL LIST

1 leno weave apparatus
3 lifting heddle
5 lifting heddle
7 semi-heddle
10 harness cord
20 clamping apparatus
22 wedge receiver device
24 clamping wedge
26 leg
28 first contact surface
29 toothed arrangement of the first contact surface
30 second contact surface
32 spring
34 guide bore
35 window in the guide bore
36 guide device
38 rail-like nose
40 groove for the nose
42 arrow
$\alpha$ angle of the first and second contact surfaces to the perpendicular

The invention claimed is:

1. A clamping apparatus for a releasable connection of a harness cord to a lifting heddle of a leno weave apparatus and arranged at an end of the lifting heddle, comprising:

a tapered clamping wedge having a tapering first contact surface angled with respect to a longitudinal direction of the lifting heddle;

a wedge receiver device displaceably receiving the clamping wedge in the longitudinal direction of the lifting heddle, the wedge receiver device having a tapered internal second contact surface facing and receiving the first contact surface of the clamping wedge, a cord-receiving spacing being defined between the first contact surface and the second contact surface for receiving the harness cord, the clamping wedge being retained in the wedge receiver device; and the harness cord running between and being in contact with the first and second contact surfaces such that the harness cord is clampingly grippable between the first contact surface of the clamping wedge and the second contact surface of the wedge receiver device.

2. The clamping apparatus according to claim 1, wherein the grip of the first and second contact surface is self-locking as the harness cord is tensioned away from the wedge receiver device.

3. The clamping apparatus according to claim 1, wherein the first and second contact surfaces are longitudinally movable relative to each other.

4. The clamping apparatus in accordance with claim 1, wherein the first contact surface is toothed.

5. The clamping apparatus in accordance with claim 4, wherein the first contact surface for the harness cord extends at an angle $\alpha$ to the longitudinal direction, the angle $\alpha$ is between 10 and 20 degrees.

6. The clamping apparatus in accordance with claim 5, wherein the second contact surface extends approximately in parallel with the first contact surface such that the harness cord is clampingly gripped on a displacement of the clamping wedge while tapering the spacing between the first and second contact surfaces.

7. The clamping apparatus in accordance with claim 1, wherein the clamping wedge is retained in the clamping receiver device by a spring that acts longitudinally on the clamping wedge.

8. The clamping apparatus in accordance with claim 5, wherein the force of the spring acts on the clamping wedge in the longitudinal direction of the lifting heddle such that a clamping connection for the harness cord is maintained.

9. The clamping apparatus in accordance with claim 5, wherein the spring is a compression spring.

10. The clamping apparatus in accordance with claim 5, wherein the spring is a spiral spring.

11. The clamping apparatus in accordance with claim 5, wherein the clamping wedge is guided in the clamping receiver device by a guidance device in the longitudinal direction of the lifting heddle.

12. The clamping apparatus in accordance with claim 11, wherein the guidance device comprises at least one rail-like nose that is guided in a correspondingly configured groove.

13. The clamping apparatus in accordance with claim 1, wherein the wedge receiver device has a leg as a part of the lifting heddle, the leg having a guide bore for the spring.

14. The clamping apparatus in accordance with claim 13, wherein the guide bore has a window.

15. A Jacquard machine having an apparatus in accordance with claim 1.

* * * * *